US010507568B2

(12) United States Patent
Phan

(10) Patent No.: US 10,507,568 B2
(45) Date of Patent: Dec. 17, 2019

(54) HAMMER WORK TOOL HAVING MULTI-POSITION RETENTION COLLAR

(71) Applicant: Caterpillar Inc., Peoria, IL (US)

(72) Inventor: Austin Phan, Waco, TX (US)

(73) Assignee: Caterpillar Inc., Peoria, IL (US)

( * ) Notice: Subject to any disclaimer, the term of this patent is extended or adjusted under 35 U.S.C. 154(b) by 344 days.

(21) Appl. No.: 15/380,942

(22) Filed: Dec. 15, 2016

(65) Prior Publication Data

US 2018/0169848 A1 Jun. 21, 2018

(51) Int. Cl.
*B25D 17/02* (2006.01)
*E02F 3/96* (2006.01)

(52) U.S. Cl.
CPC ..... *B25D 17/02* (2013.01); *E02F 3/961* (2013.01); *E02F 3/966* (2013.01); *B25D 2217/0007* (2013.01); *B25D 2250/211* (2013.01)

(58) Field of Classification Search
CPC ..... B25D 17/02; B25D 17/08; B25D 2217/0003; B25D 2217/0007; B25D 2250/211; E02F 3/961; E02F 3/966
See application file for complete search history.

(56) References Cited

U.S. PATENT DOCUMENTS 328,197 A * 10/1885 Cullingworth ..... B28D 1/26 125/6
1,346,341 A * 7/1920 Schinkez ..... B25D 17/08 279/19.4
1,372,348 A * 3/1921 Haeseler ..... B25D 17/08 279/19.6
1,603,217 A * 10/1926 Shaff ..... B25D 17/08 279/19.4
1,613,399 A * 1/1927 Axel ..... B25D 17/08 279/19.4
1,706,460 A * 3/1929 Norling ..... B25D 17/08 279/19.4
1,787,178 A * 12/1930 Stevens ..... B25D 17/08 173/137
1,787,229 A * 12/1930 Zimmermann ..... B25D 17/08 279/19.4
1,789,567 A * 1/1931 Stevens ..... B25D 17/08 173/206
1,806,315 A 5/1931 Smith, Sr.
1,807,799 A * 6/1931 Slater ..... B25D 17/086 279/19.2

(Continued)

*Primary Examiner* — Robert F Long
*Assistant Examiner* — Eduardo R Ferrero
(74) *Attorney, Agent, or Firm* — Hibshman Claim Construction PLLC

(57) ABSTRACT

A work tool for a hammer is disclosed. The work tool may include a first terminal end having a planar surface, and a second terminal end opposite the first terminal end and including a tool tip. The work tool may further include a shank between the first and second terminal ends and including a proximal first shank portion and a distal second shank portion coaxially aligned. The work tool may further include a collar between the first and second shank portions. The collar may include a rectangular portion forming lateral sides of the collar, each of the lateral sides including a planar surface that extends in a direction along an axis of the work tool. The collar may further include a flange having a diameter greater than a diameter of the shank and greater than a length of a lateral side of the rectangular portion.

20 Claims, 5 Drawing Sheets

(56) References Cited

U.S. PATENT DOCUMENTS 2,028,993 A * 1/1936 Pollard ..... B25D 17/02 279/102
2,111,280 A * 3/1938 Connell ..... B25B 23/141 173/178
2,302,069 A * 11/1942 Stephens ..... B25D 17/02 173/133
2,557,195 A * 6/1951 Neamand ..... B25D 17/02 299/100
2,629,588 A * 2/1953 Neamand ..... B25D 17/02 125/40
2,752,889 A * 7/1956 Charles ..... E01C 23/124 173/131
2,757,007 A * 7/1956 Levy ..... B25D 17/08 279/102
2,823,040 A * 2/1958 Fischer ..... B25D 17/08 173/169
3,027,953 A * 4/1962 Coski ..... B25D 17/02 175/425
3,295,613 A * 1/1967 Anderson ..... E21B 17/04 173/131
3,399,928 A * 9/1968 Robbins ..... B25D 17/02 173/118
3,458,210 A * 7/1969 Whitehouse ..... B25D 17/08 279/19.5
3,464,501 A * 9/1969 Ward ..... B25D 9/08 173/17
3,525,531 A 8/1970 Ekström et al.
3,662,855 A * 5/1972 Adams ..... B25D 17/11 173/210
3,735,824 A * 5/1973 Astrom ..... B23Q 1/015 175/213
3,972,376 A 8/1976 Price
4,067,400 A * 1/1978 Nikolaev ..... B25D 17/084 173/206
4,080,734 A * 3/1978 Barbour ..... B25B 27/0035 29/275
4,102,410 A * 7/1978 Ross ..... B25D 17/08 173/118
4,102,534 A * 7/1978 Benedict ..... B25D 9/26 173/137
4,106,573 A * 8/1978 Bailey ..... B25D 17/02 173/106
4,168,754 A * 9/1979 Nyholm ..... B25D 17/02 173/162.1
4,173,828 A * 11/1979 Lustig ..... A61C 1/07 15/28
4,436,005 A * 3/1984 Hanson ..... B25B 13/481 81/177.75
4,440,237 A * 4/1984 Casperovich ..... B25D 17/245 173/206
4,594,759 A * 6/1986 Ikeda ..... B23Q 11/0046 125/6
RE32,292 E * 11/1986 Gooden ..... B28D 1/26 125/6
4,809,787 A * 3/1989 McCauley ..... B25D 17/02 173/1
4,896,892 A * 1/1990 Andrews ..... B23B 31/1075 279/145
4,997,050 A * 3/1991 Allan ..... B25D 17/02 175/413
5,028,057 A * 7/1991 Wanner ..... B25D 17/088 279/19.3
5,107,911 A * 4/1992 Plakotaris ..... B25D 17/02 144/193.1
5,145,237 A * 9/1992 Schulz ..... B25D 17/02 125/40
5,522,606 A 6/1996 Pressley et al.
5,621,962 A * 4/1997 Okada ..... B23P 11/00 125/41
5,632,527 A * 5/1997 Halder ..... B25D 17/02 299/100
5,640,772 A * 6/1997 Roeker ..... B26B 7/00 30/169
5,730,021 A * 3/1998 Johnson ..... B25D 17/02 173/132
5,871,059 A * 2/1999 Shibata ..... B25D 11/005 173/133
5,984,596 A * 11/1999 Fehrle ..... B25D 17/088 175/395
6,000,888 A * 12/1999 Hartman ..... B23B 31/1071 173/59
6,321,855 B1 * 11/2001 Barnes ..... B25B 13/06 173/132
7,261,169 B2 8/2007 Kleine et al.
7,575,141 B1 * 8/2009 Liang ..... B25C 1/06 173/124
7,832,495 B2 11/2010 Pillers, II
8,028,762 B2 10/2011 Pillers, II et al.
9,321,165 B1 * 4/2016 Perry ..... B25F 3/00
10,201,893 B2 * 2/2019 Hauptmann ..... B25D 17/06
2003/0026669 A1 * 2/2003 Lang ..... B23B 31/005 408/226
2004/0069292 A1 * 4/2004 Szendrovari ..... B25D 17/02 125/41
2005/0103508 A1 * 5/2005 Atkinson ..... B25D 17/02 173/1
2006/0000626 A1 * 1/2006 Siltanen ..... E02F 3/3604 173/200
2007/0158089 A1 * 7/2007 Chen ..... B25D 9/04 173/210
2007/0269281 A1 * 11/2007 Ostling ..... B25D 17/08 408/239 A
2008/0006423 A1 * 1/2008 Berghauser ..... B25D 17/082 173/132
2011/0083870 A1 * 4/2011 McCarty, II ..... B25D 17/11 173/211
2011/0108301 A1 * 5/2011 Erhardt ..... B25D 11/005 173/200
2012/0038119 A1 * 2/2012 Koch ..... B25D 17/082 279/19.1
2012/0153706 A1 * 6/2012 Andrina ..... B25D 17/02 299/100
2013/0105542 A1 * 5/2013 Richardson ..... B21J 15/105 227/51
2014/0262407 A1 * 9/2014 Moore ..... B25D 9/145 173/208
2014/0346840 A1 * 11/2014 Kahra ..... B28D 1/26 299/10
2016/0279777 A1 * 9/2016 Camp ..... B25D 17/02
2017/0136611 A1 * 5/2017 Moore ..... B25D 17/02
2018/0029205 A1 * 2/2018 Livingston ..... B25B 23/0035

* cited by examiner

HAMMER WORK TOOL HAVING MULTI-POSITION RETENTION COLLAR

TECHNICAL FIELD

The present disclosure relates generally to a hammer work tool and, more particularly, to a hammer work tool having a multi-position retention collar.

BACKGROUND

Power hammers, such as hydro-mechanical hammers, typically have an actuation system and a tool assembly that includes a work tool and a retention system for holding the work tool within the hammer. In many power hammers, the actuation system drives a piston against a first end of the work tool (e.g., using a working fluid, such as compressed air or a hydraulic fluid), thereby providing a force on the work tool for breaking up work material, such a rock, concrete, etc. To prevent the work tool from being forced out of the hammer during operation, the retention system typically includes one or more components that engage certain features of the work tool to provide a hard stop in the direction of tool actuation.

One problem associated with conventional work tools is that the features of the work tool that engage the retention system of the hammer can create weak points in the tool's structure. For example, during operation, these weak points receive high impact forces by engagement with the retention system under force of the pistons. The geometry of the work tool's retention features can induce stress concentrations near these features during operation, which can lead to the sudden or eventual failure (e.g., breakage) of the work tool. In some situations, a work tool may fail long before its useful life is consumed, thereby incurring a wasteful cost.

One type of tool retention system is discussed in U.S. Pat. No. 7,832,495 to Pillers II (the '832 patent) that issued on Nov. 16, 2010. The '495 patent discloses a tool assembly of a hydraulic hammer having a housing and a chamber defined in the housing for housing a piston and a work tool. The work tool includes a shaft, a retaining flange, and a tip. The shaft passes through a tool retention member having a central aperture with a diameter smaller than the flange to limit the stroke travel of the tool during operation. The housing includes an engaging structure having a socket portion with four projections for receiving a plug portion of the work tool. The plug portion of the work tool includes four lugs that engage beneath the projections when the plug portion is inserted into the socket portion and rotated with respect to the socket portion. A tool stop is included in the socket portion to indicate when sufficient rotation has been achieved. Two set screws are used to secure the plug portion to the socket portion for preventing relative rotation of the work tool with respect to the housing.

While the system of the '495 patent may be effective to secure a work tool within a hydraulic hammer, it may not be usable with different types of hammer designs or work tool designs.

The disclosed hammer work tool is directed to overcoming one or more of the problems set forth above.

SUMMARY

In one aspect, the present disclosure is directed to a work tool for a hammer. The work tool may include a first terminal end having a planar surface, and a second terminal end opposite the first terminal end and including a tool tip. The work tool may further include a shank between the first and second terminal ends and including a proximal first shank portion and a distal second shank portion coaxially aligned. The work tool may further include a collar between the first and second shank portions. The collar may include a rectangular portion forming lateral sides of the collar, each of the lateral sides including a planar surface that extends in a direction along an axis of the work tool. The collar may further include a flange having a diameter greater than a diameter of the shank and greater than a length of a lateral side of the rectangular portion.

In another aspect, the present disclosure is directed to a hammer. The hammer may include a housing defining a chamber and a work tool configured to reciprocate within the chamber. The work tool may include a proximal first terminal end and a distal second terminal end opposite the first terminal end, the second terminal end including a tool tip. The work tool may further include a shank between the first and second terminal ends and including a first shank portion and a second shank portion coaxially aligned. The work tool may further include a collar between the first and second shank portions, the collar including a rectangular portion forming lateral sides of the collar, and a flange having a diameter greater than a diameter of the shank and greater than a length of a lateral side of the rectangular portion. The flange may include a plurality of curved surfaces, each curved surface being aligned with a respective one of the lateral sides of the collar. The hammer may further include a pair of parallel retention pins supported by the housing, each retention pin being positioned to support the collar via contact with a respective one of the lateral sides of the collar.

In yet another aspect, the present disclosure is directed to a work tool for a hammer. The work tool may include a first terminal end having a planar surface, and a second terminal end opposite the first terminal end and including a tool tip. The work tool may further include a shank between the first and second terminal ends and including a proximal first shank portion and a distal second shank portion coaxially aligned. The work tool may further include a collar between the first and second shank portions. The collar may include a rectangular portion forming lateral sides of the collar, each of the lateral sides including a planar surface that extends in a direction along an axis of the work tool. The collar may further include a flange having a diameter greater than a diameter of the shank and greater than a length of a lateral side of the rectangular portion. The flange may include a proximal side having a proximal surface, and a distal side having a plurality of curved surfaces, each of the plurality of curved surfaces including a concave portion and being aligned with the planar surface of one of the lateral sides of the collar. The tool tip may include one of a chisel, a moil point, a percussion buster, a blunt tool, a ramming tool, a tamping plate, and a cutter.

DETAILED DESCRIPTION

Reference will now be made in detail to exemplary embodiments that are illustrated in the accompanying drawings. Wherever possible, the same reference numbers will be used throughout the drawings to refer to the same or like parts.

Figure 1:
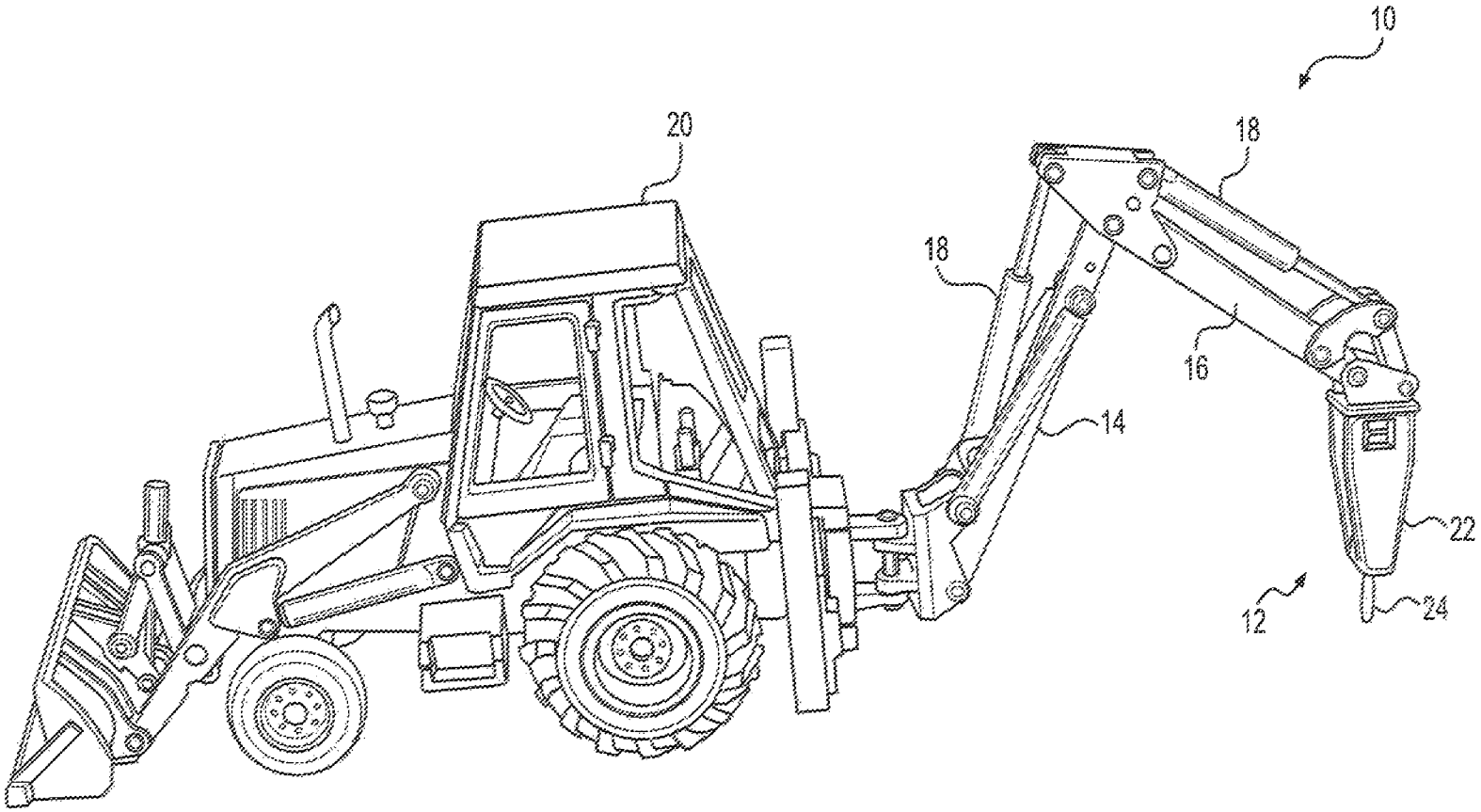
FIG. 1 is a perspective view illustration of an exemplary machine equipped with a hammer.

FIG. 1 illustrates an exemplary disclosed machine 10 having a hydraulic hammer 12. Machine 10 may be configured to perform work associated with a particular industry, such as, for example, mining or construction. Machine 10 may be a backhoe loader (shown in FIG. 1), an excavator, tool carrier, skid steer loader, or any other type of machine. Hammer 12 may be pivotally connected to machine 10 through a boom 14 and a stick 16. Alternatively, hammer 12 may be connected to machine 10 in another way.

Machine 10 may include a hydraulic supply system (not shown in FIG. 1) for moving and powering hammer 12. For example, machine 10 may include a pump connected through one or more hydraulic supply lines (not shown in FIG. 1) to hydraulic cylinders 18 associated with boom 14 and stick 16 to correspondingly raise, lower, and/or swing hammer 12. Operator controls for movement of hydraulic cylinders 18 and/or hammer 12 may be located within a cabin 20 of machine 10. As shown in FIG. 1, hammer 12 may include a housing 22, which may be connected to stick 16. A work tool 24 may be operatively connected to an end of housing 22 opposite stick 16. It is contemplated that work tool 24 may include any work tool capable of interacting with hammer 12. For example, work tool 24 may include a chisel bit, moil point, percussion buster, blunt tool, ramming tool, tamping plate, cutter, or other type of tool or bit.

Figure 2B:
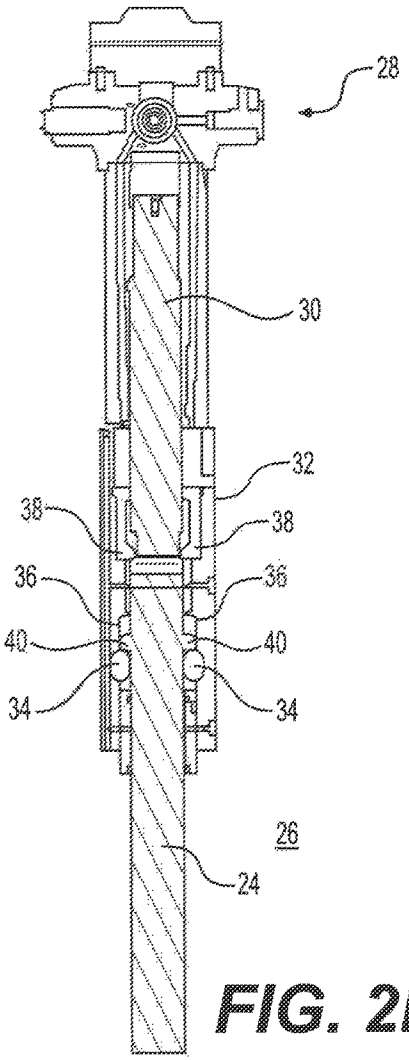
FIG. 2B is a cross-sectional view illustration of the hammer of FIG. 2A.
Figure 2A:
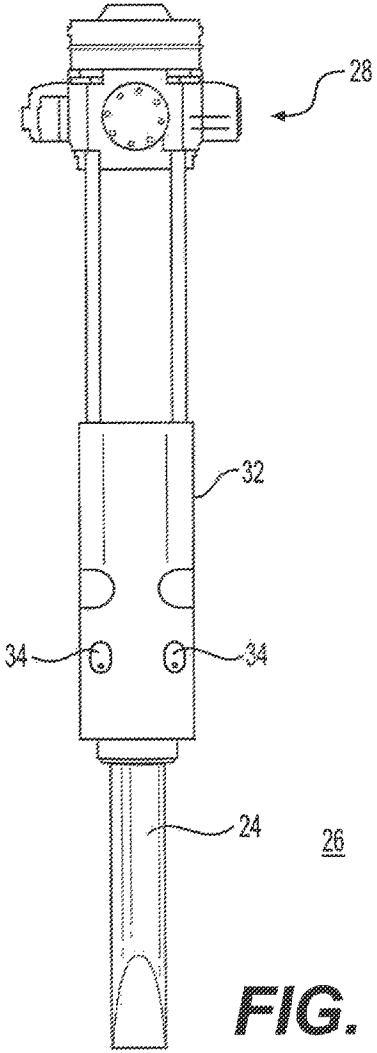
FIG. 2A is a front view illustration of the hammer of FIG. 1.

FIG. 2A shows a power cell 26 that may be disposed within housing 22 of hammer 12 (referring to FIG. 1). Power cell 26 may include a head 28 configured to receive hydraulic power for driving work tool 24. Head 28 may be configured to drive a piston 30 (shown in FIG. 2B) reciprocally through power cell 26 in order to drive (e.g., through striking contact) work tool 24. Power cell 26 may further include a frame 32 connected to head 28 and configured to at least partially house piston 30 and work tool 24. Work tool 24 may be retained within frame 32 using a plurality of retaining pins 34 (e.g., a pair of retention pins 34). Retaining pins may be configured to be inserted through apertures (e.g., holes) in frame 32 for supporting and retaining work too 24 within frame.

FIG. 2B shows a cross-sectional view of power cell 26. As shown, retention pins 34 may be connectable to frame 32 and configured to support work tool 24 within a chamber 36 defined by or within frame 32. Work tool may be configured to move freely within chamber 36 between retention pins 34 and a tool stop 38. Tool stop 38 may be a trust ring or other type of component configured to provide a hard stop to work tool 24. For example, when work tool 24 is pressed against a work surface (such as a stone, a concrete slab, etc.), work tool 24 may be forced upward (i.e., toward tool stop 38). When work tool 24 is close enough to piston 30 to make contact, piston 30 (when driven by head 28) may apply a downward force (i.e., toward the work surface) on work tool 24. Work tool 24 may include a collar 40 configured to engage tool stop 38, thereby stopping the downward movement of work tool 24 and retaining work tool 24 within chamber 36.

Figure 3B:
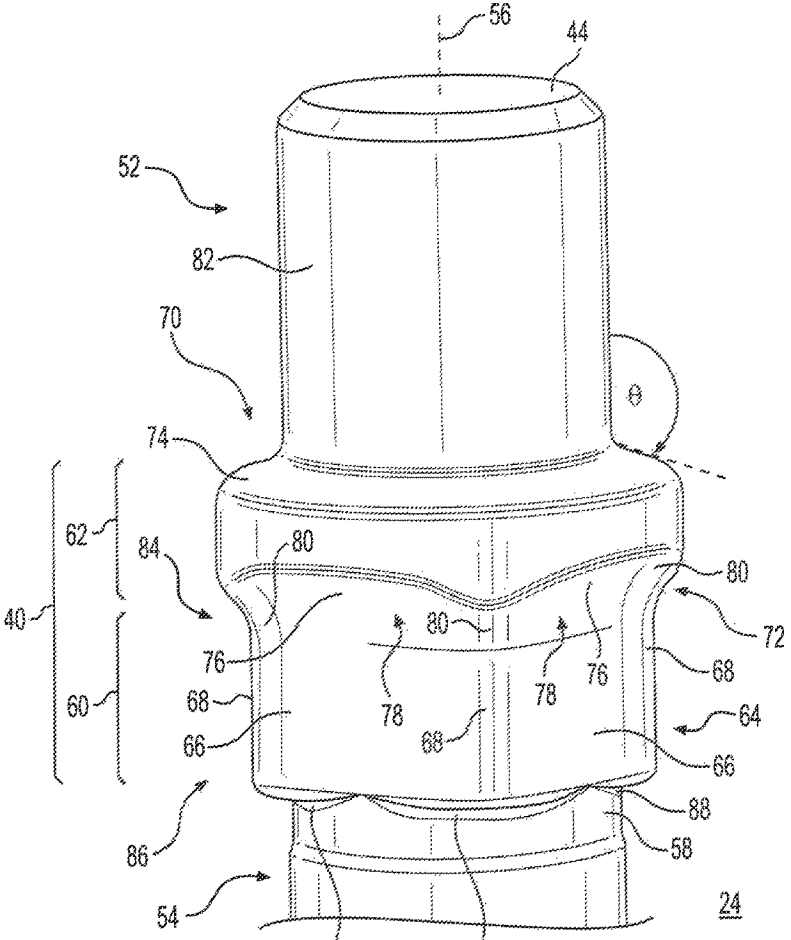
FIG. 3B is a zoomed-in view of a portion of the work tool of FIG. 3A.
Figure 3A:
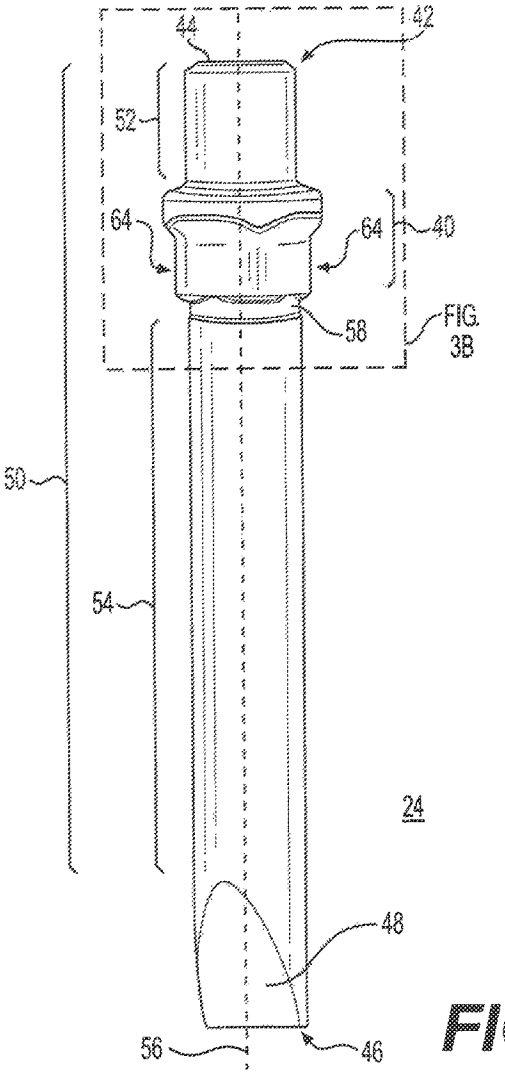
FIG. 3A is a perspective view illustration of an exemplary work tool that may be used with the hammer of FIGS. 2A and 2B.

As shown in FIG. 3A, work tool 24 may include a first terminal end 42 having a planar surface 44. First terminal end 42 may define a proximal end of work tool 24. Planar surface 44 may be configured to engage piston 30 (referring to FIG. 2B) during operation of hammer 12. Work tool 24 may further include a second terminal end 46 opposite first terminal end 42. Second terminal end 46 may include a tool tip 48 and define a distal end work tool 24. Tool tip 48 may embody an type of tool tip, such as a chisel, moil point, percussion buster, blunt tool, ramming tool, tamping plate, cutter, or other type of tip. As used herein, the terms "proximal" and "distal" may refer to relative positioning of work tool 24 components with respect to piston 30 (referring to FIG. 2B). For example, proximal components may be closer to piston 30 than distal components.

Work tool 24 may further include a shank 50 between first and second terminal ends 42 and 46. In some embodiments, shank 50 may be a cylindrical section of work tool 24 defining a portion of a length of work tool 24. In other embodiments, shank 50 may be or include portions that are cylindrical, rectangular (e.g., square), hexagonal, and/or octagonal, etc. Shank 50 may include multiple components or sections provided at different locations of work tool 24. For example, shank 50 may include a proximal first shank portion 52 and a distal second shank portion 54. In some embodiments, first and second shank portions 52 and 54 have the dame diameter. In other embodiments, first and second shank portions 52 and 54 have different diameters, for example, to accommodate other features of hammer 12, to affect the overall weight of work tool 24, or for another reason. First and second shank portions 52 and 54 may be separated by other components of work tool 24. For example, collar 40 may be located between first and second shank portions 52 and 54 (i.e., first and second shank portions may be separated by collar 40). First and second shank portions 52 and 54 may also be coaxially aligned, for example, with respect to a central axis ("axis") 56 of work tool 24. Shank 50 may further include a transition section 58 between collar 40 and second shank portion 54. Transition section 58 may be a portion of shank 50. In the example of FIG. 3A, transition portion 58 may be a portion of second shank portion 54 having a smaller diameter than an adjacent shank portion (i.e., than the rest of second shank portion 54). Transition section 58 may be located at or near a location of shank 50 where one or more sections or portions of work tool 24 come together, are joined, or transition from one to another in a direction along axis 56.

With reference to FIG. 3B, collar 40 may include a rectangular portion 60 and a flange 62. Rectangular portion 60 may form lateral sides 64 (shown in FIG. 3A) of collar 40. Each lateral side 64 may include a planar surface 66 that extends in a direction along axis 56 of work tool. Lateral sides 64 may include features of collar 40 that are visible from a perspective normal to a given planar surface 66. For example, rectangular portion 60 may have four lateral sides 64 (two lateral sides 64 shown in FIG. 3B). Each lateral side 64 may be further defined by (e.g., separated from adjacent lateral sides by) by first corner radius portions 68. For example, each lateral side 64 (or each planar surface 66) may terminate in a lateral direction (i.e., in a direction perpendicular to axis 56) at a first corner radius portion 68. Each of the lateral sides 64 of collar 40 may have a length L equal to a diameter of a portion of shank 50. For example, with reference to FIG. 3C, the length L of each lateral side 64 may be equal to a diameter $D_1$ of transition section 58. In other embodiments, the length L of each lateral side may be equal to, for example, a diameter $D_2$ of first shank portion, a diameter $D_3$ of second shank portion, a diameter $D_4$ of planar surface 44, or another portion or section of shank 50. In order for flange 62 to be configured to engage retention pins 34 (referring to FIGS. 2A and 2B, the length L of each lateral side 64 may be less than a diameter $D_5$ of flange 62.

Figure 3C:
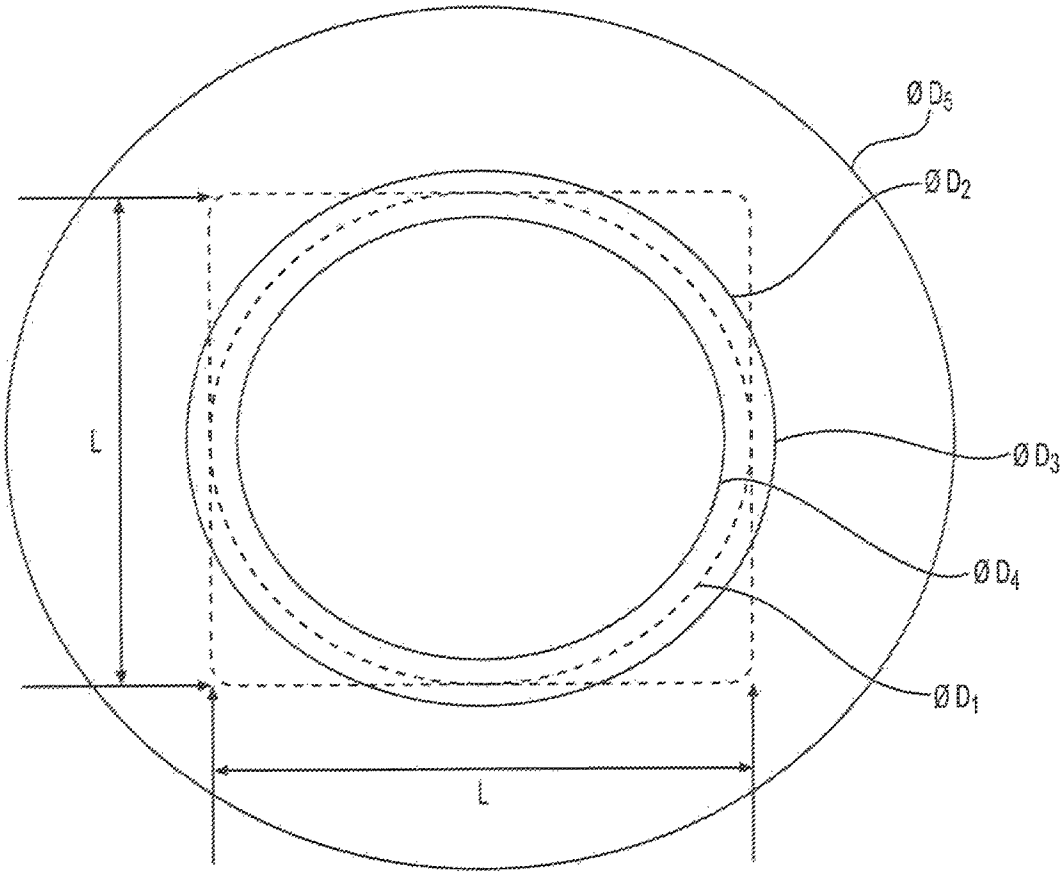
FIG. 3C is a top view illustration of work tool 24.

As also shown in FIG. 3C, flange 62 may have an outer dimension (e.g., $D_5$) greater than the shank (e.g., $D_1$, $D_2$, and $D_3$) and the rectangular portion (e.g., length L). In this way, flange 62 may be configured to engage retention pins to support and stop the travel of work tool 24 within hammer 12. For example, referring again to FIG. 3B, flange 62 may include a proximal side 70 and a distal side 72. Proximal side may include a proximal surface 74. Distal side 72 may be configured to engage retention pins 34 of hammer 12. For example, distal side 72 may include a plurality of curved surfaces 76. Each curved surface 76 may be aligned with the planar surface 66 of one of the lateral sides 64 of collar 40. That is, each curved surface 76 may be proximal to a planar surface 66 and extend at least partially along lateral side 64 in the same direction as length L (referring to FIG. 3C) of lateral side 64. Each curved surface 76 may be or include a concave surface portion 78 configured to engage retention pins 34.

Each of the plurality of curved surfaces 76 may be separated from adjacent curved surfaces 76 by second corner radius portions 80. Second corner radius portions 80 may be contoured to reduce the size of collar 40 from the diameter $D_5$ of flange 62 to the length L of lateral side 64 (referring to FIG. 3C). As shown in FIG. 3B, each first corner radius portion 68 may be aligned with one of the second corner radius portions 80. For example, each first corner radius portion 68 may be aligned with a second corner radius portion 80 in a direction parallel to axis 56 of work tool 24.

As shown in FIG. 3B, proximal surface 74 of flange 62 may be an annular surface concentric with the first shank portion 52. First shank portion 52 may include an outer surface 82 that extends in a direction along axis 56, and proximal surface 74 and outer surface 82 of the first shank portion may be separated by an angle θ to enable flange 62 to maintain a clearance space with other features or components of hammer 12. For example, proximal surface 74 and outer surface 82 of the first shank portion may be separated by at least 90 degrees.

Referring now to FIGS. 3A and 3B, rectangular portion 60 of collar 40 may include a proximal portion 84 and a distal portion 86. Proximal portion 84 of rectangular portion 60 may be connected to the plurality of curved surfaces 76 of the flange. Distal portion 86 may be connected to the second shank portion 54 (e.g., at or through transition portion 58). As shown in FIG. 3B, work tool 24 may include a plurality of concave radius portions 88 between distal end 86 of rectangular portion 60 and transition portion 58 of second shank portion 54. Concave radius portions 88 may be configured to strengthen work tool 24 in the region where rectangular portion 60 of collar 40 joins second shank portion 54. Concave radius portions 88 may be circumferentially spaced about axis 56 of work tool 24 to ensure the strength of work tool 24 on each side. For example, each concave radius portion 88 may extend circumferentially between a first planar surface 66 and an adjacent other planar surface 66. In this way, concave radius portions 88 may be configured to also provide strength in areas distal to (and/or below) first corner radius portions 68.

Figure 4B:
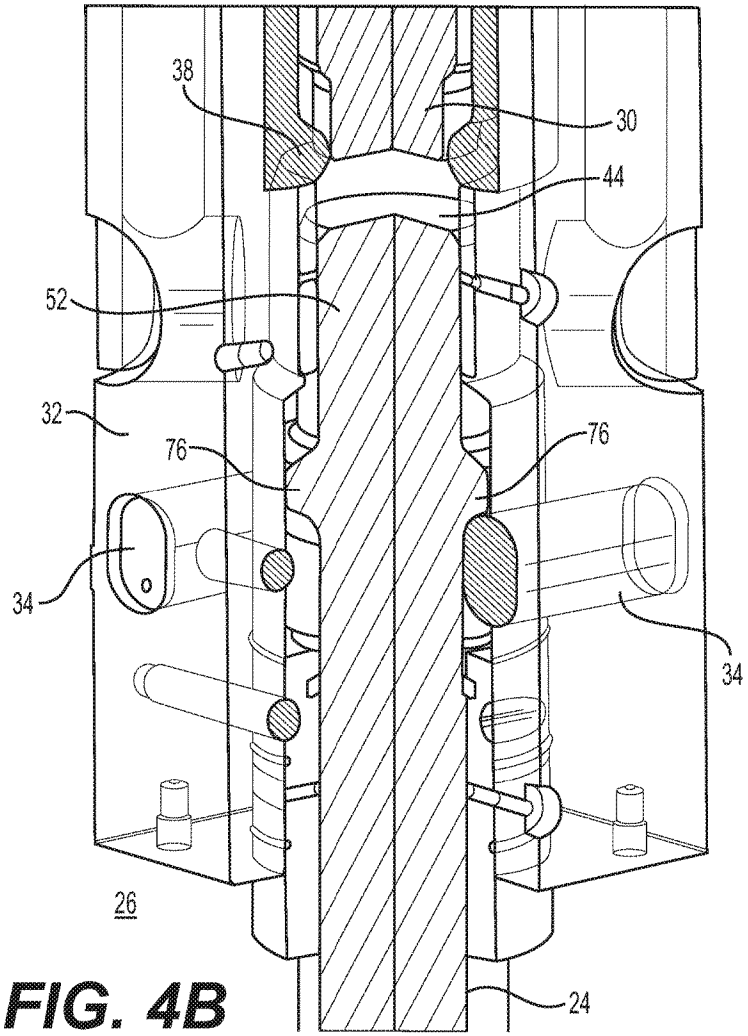
FIG. 4B is a cross-sectional perspective view of a portion of the hammer of FIGS. 2A and 2B.
Figure 4A:
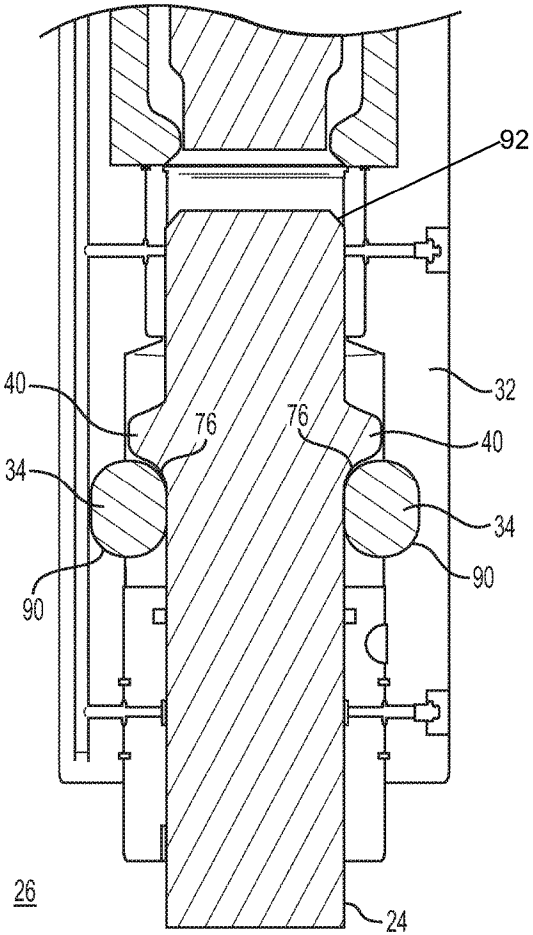
FIG. 4A is a cross-sectional front view of a portion of the hammer of FIGS. 2A and 2B.

FIGS. 4A and 4B show cross-sectional views of power cell 26 of hammer 12. As shown, retention pins 34 may be supported by frame 32 and may be positioned to be parallel with each other (i.e., retention pins 34 may be parallel retention pins 34). Each retention pin 34 may be positioned to support collar 40 via contact with a respective one of the lateral sides 64 (referring to FIG. 3A) of collar 40. For example curved surfaces 76 of collar 40 may be configured to engage retention pins 34, and retention pins 34 may be positioned to support collar 40 via curved surfaces 76. That is, retention pins 34 may be configured (e.g., shaped) to compliment concave surface portions 78 (shown in FIG. 3B) of curved surfaces 76. For example, retention pins 34 may include a curved outer surface 90 configured to compliment concave surface portions 78 of curved surfaces 76.

As shown in FIG. 4B, tool stop 38 may be positioned above work tool 24 near first shank portion 52. During operation, piston 30 may contact planar surface 44 to drive work tool 24 reciprocally within hammer 12. During an upstroke of work tool 24, tool stop 38 may engage work tool 12 to stop its upward motion. Tool stop 38 may therefore be configured to engage a portion 92 of first shank portion 52. Portion 92 of first shank portion 52 may be a beveled edge, or other type of surface for contacting tool stop 38.

During operation, as work tool 24 breaks through work material, cracks and crevices may form in the work material, which may be easy for work tool to slide into under its own weight and the forces of piston 30. When work tool is driven into such a crack or crevice, a rotational torque can be applied to work tool 24 as a result of reaction forces generated by the reengagement of work tool 24 with work material. Such torque may urge work tool 24 to rotate within hammer 12. Each retention pin 34 may be configured to engage a length of a respective one of the lateral sides 64 (referring to FIG. 3A) of collar 40 to prevent rotation of work tool 24 within hammer 12. That is, the rectangular shape of rectangular portion 60 (referring to FIG. 3B) of collar 40, in conjunction with planar surfaces 66, may allow retention pins 34 to engage a greater surface area (e.g., as compared to a round surface), which may improve the ability of hammer 12 to resist rotation of work tool 24.

Industrial Applicability

The disclosed hammer work tool finds potential application in power hammers, such as hydraulic hammers, pneumatic hammers, breakers, etc., where a work tool used with the hammer may break or wear over time. The disclosed hammer work tool finds particular applicability with construction and demolition application in which a work tool may break or be worn quickly or unevenly due to the type of work material being broken up or the orientation of the hammer during operation.

For example, during operation of hammer 12, work tool 24 may sustain significant stress with each hammer blow as work tool 24 is stopped on retention pins 34 an tool stop 38. Breakage of work tool 24 due to this stress can be reduced by collar 40. That is, work tool 24 may be strengthened by collar 40, thereby reducing the likelihood that work tool will fail near its engagement point with retention pins 34. In contrast to other work tools that utilize features within a narrow neck to engage retention pins, work tool 24 includes additional material to provide strength and support to the work tool 24. Additionally, curved surfaces 76 and concave radius portions 88 may be configured to add further strength to collar 40 and work tool 24 to reduce stress concentrations, distribute load, and reduce the likelihood of failure. Collar 40 may also resist wear induced by torque on work tool 24 that is generated when work tool slips through and reengages work material. For example, the planar surfaces 66 of each side 64 of collar 40 may provide a larger surface area for contacting retention pins, which provides a greater area to counteract torque on work tool 24. In this way, unwanted rotation is prohibited, and the wear rate of work tool 24 can be reduced in those areas.

Further, the rectangular shape of rectangular portion 60 of collar 40 may be configured to allow users to rotate work tool 24 by 90 degrees or 180 degrees when work tool becomes dull, is unevenly worn, or has sustained wear near the area where it engages retention pins 34. For example, during operation, tool tip 48 can become unevenly worn when hammer 12 is maintained in a certain orientation for a certain period of time or when the work material is very hard. With conventional work tools, the user may, in some situations, be able to rotate the work tool by 180 degrees and continue working with the less-worn portion of the work tool. In contrast, work tool 24 includes a rectangular portion 60 of collar 40 that enables a user to rotate work tool by 90 degrees in either direction (e.g., clockwise or counter clockwise) in addition to 180 degrees. In this way, the user can simply remove retention pins 34, rotate the work tool 24, and reinsert retention pins 34, and continue working without completely changing work tool 24. In this way, fewer work tools may be discarded before their full useful life has expired. This can lead to significant cost savings and reduce waste.

One skilled in the art will recognize that the disclosed hammer work tool could be utilized in relation to other types of hammers or other situations where a work tool is inserted into a machine and driven for using the work tool to break up work material. For example, the disclosed hammer work tool may be applicable to handheld pneumatic hammers, electric hammers, other types of power hammers.

It will be apparent to those skilled in the art that various modifications and variations can be made to the hammer work tool of the present disclosure. Other embodiments of the hammer work tool will be apparent to those skilled in the art from consideration of the specification and practice of the hammer work tool disclosed herein. It is intended that the specification and examples be considered as exemplary only, with a true scope being indicated by the following claims and their equivalents.

What is claimed is:

1. A work tool for a hammer, the work tool comprising:
- a first terminal end having a planar surface;
- a second terminal end opposite the first terminal end and including a tool tip;
- a shank disposed between the first and second terminal ends and including a proximal first shank portion coaxially aligned with a distal second shank portion;
- a collar integrally fixed relative to the shank along a longitudinal axis of the work tool and disposed between the first and second shank portions, the collar being formed from a same material as the shank, the first shank portion being disposed between the collar and the first terminal end along the longitudinal axis of the work tool, the longitudinal axis of the work tool extending from the first terminal end toward the second terminal end, the collar including:
  - a rectangular portion forming lateral sides of the collar, each side of the lateral sides including a planar surface that extends in a direction parallel to the longitudinal axis of the work tool; and
  - a flange having a diameter greater than a diameter of the shank and greater than a length of a side of the lateral sides of the collar, the length of the side of the lateral sides of the collar extending along the longitudinal axis, the flange being disposed between the rectangular portion and the first terminal end along the longitudinal axis of the work tool.

2. The work tool of claim 1, wherein the flange includes:
- a proximal side having a proximal surface; and
- a distal side having a plurality of curved surfaces, each curved surface of the plurality of curved surfaces being aligned with the planar surface of one side of the lateral sides of the collar,
- the proximal side of the flange being disposed between the distal side of the flange and the first terminal end along the longitudinal axis of the work tool.

3. The work tool of claim 2, wherein each side of the lateral sides of the collar is separated from adjacent lateral sides by first corner radius portions.

4. The work tool of claim 3, wherein each curved surface of the plurality of curved surfaces of the distal side of the flange is separated from adjacent curved surfaces by second corner radius portions.

5. The work tool of claim 4, wherein each first corner radius portion of the first corner radius portions is aligned with one second corner radius portion of the second corner radius portions in a direction parallel to the longitudinal axis of the work tool.

6. The work tool of claim 2, wherein each curved surface of the plurality of curved surfaces of the distal side of the flange includes a concave surface.

7. The work tool of claim 2, wherein the proximal surface of the flange is an annular surface concentric with the first shank portion.

8. The work tool of claim 7, wherein:
- the first shank portion includes an outer surface; and
- the proximal surface of the flange and the outer surface of the first shank portion are separated by an angle of at least 90 degrees.

9. The work tool of claim 1, wherein each side of the lateral sides of the collar has a length equal to a diameter of a portion of the shank.

10. The work tool of claim 2, wherein the rectangular portion of the collar includes:
- a proximal portion connected to the plurality of curved surfaces of the flange; and
- a distal portion connected to the second shank portion.

11. The work tool of claim 10, wherein the second shank portion includes a transition section connected to the distal portion of the rectangular portion, a diameter of the transition section being smaller than a diameter of a remainder of the second shank portion.

12. The work tool of claim 11, further including a plurality of concave radius portions between the distal end of the rectangular portion and the transition portion of the second shank portion.

13. The work tool of claim 12, wherein the plurality of concave radius portions between the distal end of the rectangular portion and the transition portion of the second shank portion are circumferentially spaced about the longitudinal axis of the work tool, each concave radius portion of the plurality of concave radius portions extending circumferentially between one planar surface of the planar surfaces of the rectangular portion and an adjacent planar surface of the rectangular portion.

14. The work tool of claim 1, wherein the lateral sides of the rectangular portion includes a first side, a second side, a third side, and a fourth side,
- the first side disposed opposite the third side,
- the second side disposed opposite the fourth side, the second side disposed adjacent to both the first side and the third side, the fourth side disposed adjacent to both the first side and the third side.

15. A hammer, comprising:

a frame defining a chamber;

a work tool disposed within the chamber and configured to reciprocate within the chamber, the work tool including;

a proximal first terminal end and a distal second terminal end opposite the first terminal end, the second terminal end including a tool tip;

a shank disposed between the first and second terminal ends and including a first shank portion coaxially aligned with a second shank portion;

a collar integrally fixed relative to the shank along a longitudinal axis of the work tool and disposed between the first and second shank portions, the collar being formed from a same material as the shank, the first shank portion being disposed between the collar and the first terminal end along the longitudinal axis of the work tool, the longitudinal axis of the work tool extending from the first terminal end toward the second terminal end, the collar including:

a rectangular portion forming lateral sides of the collar;

a flange having diameter greater than a diameter of the shank and greater than a length of a side of the lateral sides of the collar, the length of the side of the lateral sides of the collar extending along the longitudinal axis, the flange being disposed between the rectangular portion and the first terminal end along the longitudinal axis of the work tool, the flange including a plurality of curved surfaces, each curved surface being aligned with a respective one side of the lateral sides of the collar; and a pair of parallel retention pins supported by the frame, each retention pin of the pair of parallel retention pins being positioned to support the collar via contact with a respective one side of the lateral sides of the collar.

16. The hammer of claim 15, wherein:

each curved surface of the plurality of curved surfaces of the flange includes a concave portion; and each retention pin of the pair of retention pins includes a curved outer surface configured to engage the concave portion of a respective one curved surface of the plurality of curved surfaces.

17. The hammer of claim 15, wherein each retention pin of the pair of parallel retention pins is configured to engage a length of a respective one lateral side of the lateral sides of the collar.

18. The hammer of claim 15, further comprising a tool stop configured to engage the first shank portion.

19. The hammer of claim 15, wherein the tool tip includes one of a chisel, a moil point, a percussion buster, a blunt tool, a ramming tool, a tamping plate, and a cutter.

20. A work tool for a hammer, the work tool comprising:

a first terminal end having a planar surface;

a second terminal end opposite the first terminal end and including a tool tip;

a shank disposed between the first and second terminal ends and including a proximal first shank portion coaxially aligned with a distal second shank portion;

a collar integrally fixed relative to the shank along a longitudinal axis of the work tool and disposed between the first and second shank portions, the collar being formed from a same material as the shank, the first shank portion being disposed between the collar and the first terminal end along the longitudinal axis of the work tool, the longitudinal axis of the work tool extending from the first terminal end toward the second terminal end, the collar including:

a rectangular portion forming lateral sides of the collar, each side of the lateral sides including a planar surface that extends in a direction parallel to the longitudinal axis of the work tool; and a flange having a diameter greater than a diameter of the shank and greater than a length of a lateral side of the rectangular portion, the length of the lateral side of the rectangular portion extending along the longitudinal axis. the flange being disposed between the rectangular portion and the first terminal end along the longitudinal axis of the work tool, the flange including:

a proximal side having a proximal surface; and a distal side having a plurality of curved surfaces, each curved surface of the plurality of curved surfaces including a concave portion and being aligned with the planar surface of one side of the lateral sides of the collar, wherein the tool tip includes one of a chisel, a moil point, a percussion buster, a blunt tool, a ramming tool, a tamping plate, and a cutter.

* * * * *